US006484335B2

(12) United States Patent
Gilbert

(10) Patent No.: US 6,484,335 B2
(45) Date of Patent: Nov. 26, 2002

(54) PILLOW APPARATUS

(76) Inventor: Tony Gilbert, 122 Lipton La., Danville, VA (US) 24541

( * ) Notice: Subject to any disclaimer, the term of this patent is extended or adjusted under 35 U.S.C. 154(b) by 0 days.

(21) Appl. No.: 09/738,156

(22) Filed: Dec. 15, 2000

(65) Prior Publication Data

US 2001/0049844 A1 Dec. 13, 2001

Related U.S. Application Data

(60) Provisional application No. 60/174,030, filed on Dec. 30, 1999.

(51) Int. Cl.[7] ..... A47G 9/00; A47G 7/38

(52) U.S. Cl. ..... 5/636; 5/639; 5/640; 5/485; 5/922; 297/397; D6/601

(58) Field of Search ..... 5/636, 639, 640, 5/645, 485, 490, 922; 297/220, 284.5, 397, DIG. 6; D24/183; D6/601

(56) References Cited

U.S. PATENT DOCUMENTS

| | | | | | |
|---|---|---|---|---|---|
| 247,823 | A | * | 10/1881 | Hiller | 297/395 |
| 2,677,834 | A | * | 5/1954 | Moynihan | 128/872 |
| 2,874,757 | A | * | 2/1959 | Requa | 297/400 |
| D195,197 | S | * | 5/1963 | Requa | D6/601 |
| 4,097,086 | A | * | 6/1978 | Hudson | 297/217.1 |
| 4,240,480 | A | * | 12/1980 | Strobel | 383/15 |
| 4,471,993 | A | * | 9/1984 | Watson | 297/284.5 |
| 4,535,878 | A | * | 8/1985 | Grahl | 5/639 X |
| D296,930 | S | * | 7/1988 | Carabelli | D24/190 |
| 4,815,154 | A | * | 3/1989 | Grimes | 5/657 |
| 4,901,898 | A | * | 2/1990 | Colombo et al. | 224/159 |
| 5,011,056 | A | * | 4/1991 | Larreategui | 224/159 |
| D332,663 | S | * | 1/1993 | Liszewski | D24/190 |
| D333,403 | S | * | 2/1993 | Perrone | D6/601 |
| 5,224,637 | A | * | 7/1993 | Colombo | 224/159 |
| D338,587 | S | * | 8/1993 | Harnish | D6/601 |
| 5,240,330 | A | * | 8/1993 | Thompson | 5/639 X |
| D340,379 | S | * | 10/1993 | Cain | D6/601 |
| 5,345,633 | A | | 9/1994 | Harnish | 5/639 |
| 5,487,197 | A | * | 1/1996 | Iskra, Jr. et al. | 5/654 |
| 5,503,456 | A | | 4/1996 | Rossini | 297/397 |

(List continued on next page.)

FOREIGN PATENT DOCUMENTS

| | | | | |
|---|---|---|---|---|
| AU | 152969 | * | 8/1953 | 297/397 |
| FR | 1193084 | * | 10/1959 | 297/397 |

*Primary Examiner*—Robert G. Santos

(57) ABSTRACT

A pillow apparatus includes a pillow unit which includes a first pillow end and a second pillow end which are situated along a longitudinal pillow axis. The pillow unit also includes a front pillow face and a rear pillow face. A first strap is connected to the first pillow end, and a second strap is connected to the second pillow end. The pillow unit can include a pillow housing and a pillow cushion retained in the pillow housing. A pocket assembly is connected to the pillow unit. The pocket assembly includes a zipper or Velcro fastener. The pocket assembly is connected to the rear pillow face. Each of the first strap and the second strap includes a respective strap length first connector and a strap length second connector. The first strap and the second strap are connected to the respective pillow ends by respective strap-mounted connectors.

10 Claims, 4 Drawing Sheets

U.S. PATENT DOCUMENTS

D369,666 S * 5/1996 Lucero et al. ..... D24/183
5,544,378 A * 8/1996 Chow ..... 5/640 X
D373,278 S * 9/1996 Chow ..... D6/604
5,567,015 A * 10/1996 Arias ..... 297/397
D379,047 S * 5/1997 Richard ..... D6/601
D382,164 S * 8/1997 Hays ..... D6/601
5,685,613 A 11/1997 Franzen ..... 297/397
5,718,010 A * 2/1998 Beier ..... 5/636
5,727,841 A 3/1998 Morley ..... 297/188.06
D393,172 S * 4/1998 Brady ..... D6/601
5,735,004 A * 4/1998 Wooten et al. ..... 5/485 X
D406,486 S * 3/1999 Ogilvie ..... D6/596
5,904,406 A 5/1999 Stewart ..... 297/397
D420,408 S * 2/2000 Santimaw ..... D21/694
6,030,034 A * 2/2000 Plohetski ..... 297/188.06
D428,294 S * 7/2000 Teel ..... D6/601
6,086,152 A * 7/2000 Zeller ..... 297/284.5
6,126,237 A * 10/2000 Ritterhouse ..... 297/397
D436,281 S * 1/2001 Thompson ..... D6/596
D445,506 S * 7/2001 Vinson et al. ..... D24/183
6,299,248 B1 * 10/2001 Gennaro et al. ..... 297/230.13

* cited by examiner

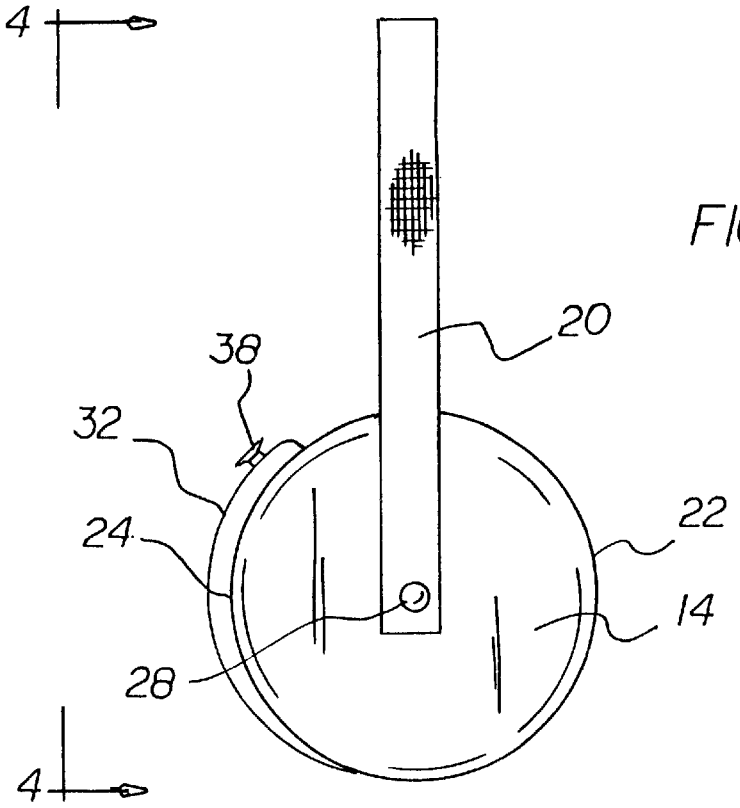
FIG 3
FIG 4
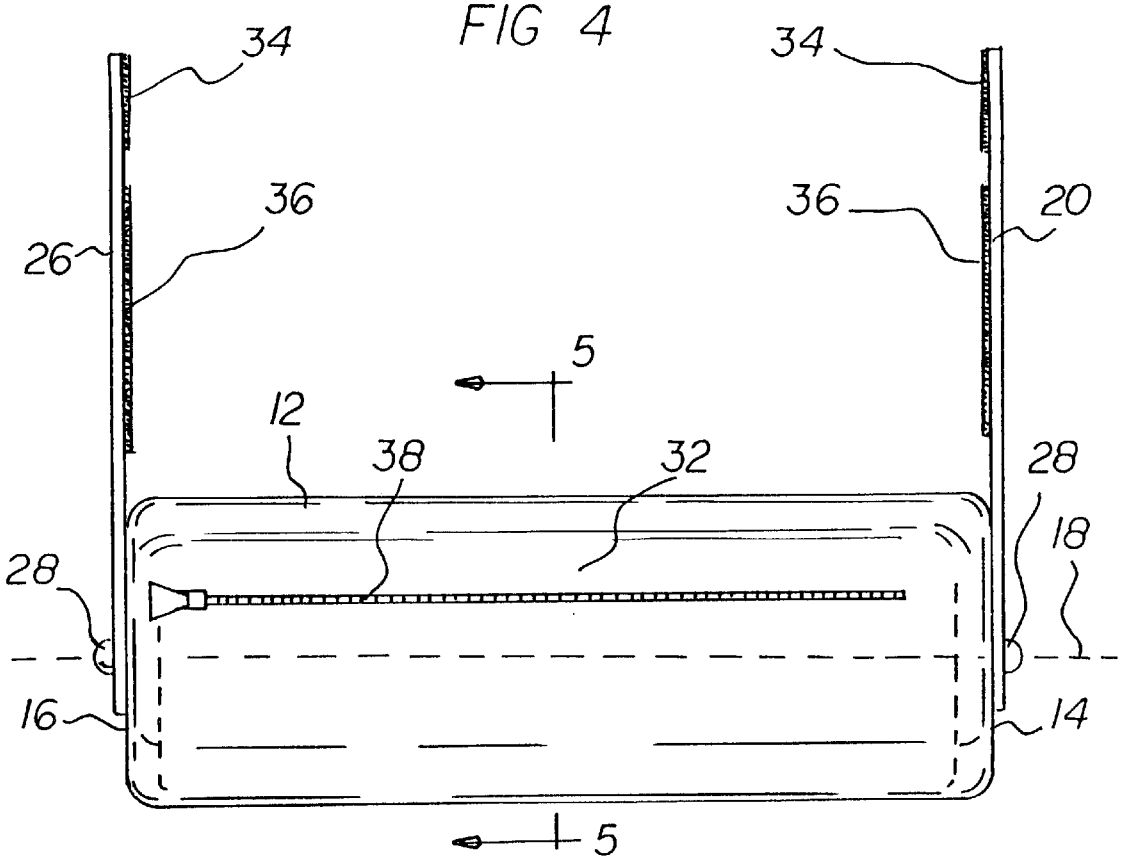

PILLOW APPARATUS

CROSS-REFERENCE TO RELATED APPLICATION

This application claims priority based upon my copending Provisional Application Ser. No. 60/174,030, filed Dec. 30, 1999.

BACKGROUND OF THE INVENTION

1. Field of the Invention

The present invention relates generally to cushions or pillows used for a person's head and, more particularly, to a pillow or cushion especially adapted for attaching to the back of a seat or chair.

2. Description of the Prior Art

Chair backs, especially backs of lawn chairs and the like which are used outdoors, often do not have cushions or pillows for the head of the used of the chair. To overcome this deficiency, throughout the years, a number of innovations have been developed relating to portable pillows or cushions that can be attached to chair backs, and the following U.S. patents are representative of some of those innovations: U.S. Pat. Nos. 5,345,633, 5,503,456, 5,685,613, 5,727,841, and 5,904,406. More specifically, U.S. Pat. No. 5,345,633 discloses a cushion that has an internal storage pouch and has straps with Velcro ends that attach to complementary Velcro material on the back panel of the cushion. In this respect, the straps are not connected to the sides or ends of the cushion, just the back. To provide improved security and stability for attaching straps to a cushion, it would be desirable if the straps could be attached to Velcro located at the ends of the cushion.

U.S. Pat. No. 5,503,456 discloses a headrest that has a separate pillow and a separate pouch. The pouch is not part of the outer portion of the pillow. To reduce complexity and provide for greater compactness, it would be desirable if a pouch were made integral with a wall of a pillow.

U.S. Pat. No. 5,685,613 discloses a pillow that has straps permanently attached to the ends of the pillow. The straps are used to attach the pillow to a chair back. However, if the pillow is used without being attached to a chair back, the permanently attached straps can get in the way of comfortable pillow use. In this respect, it would be desirable if straps were provided for a pillow that can easily be attached to and detached from the ends of the pillow.

U.S. Pat. No. 5,727,841 discloses a pillow that attaches to the back of a lounge chair. The pillow is constructed to have a slot or pocket into which the back of the lounge chair is received when the pillow is placed on the chair back. The presence of the slot or pocket requires that the pillow be constructed in essentially two independent portions which define the slot or pocket. For purposes of simplicity and convenience, it would be desirable if a pillow were provided that includes a single pillow portion for attaching to the back of a chair without employing a chair back reception slot or pocket.

U.S. Pat. No. 5,904,406 discloses a headrest that has a C-shaped cross-section and that snaps in place over the top tube of the frame of any of a wide variety of lawn or beach furniture. Because of the C-shaped nature of the headrest, when the headrest is installed on a chair back, one-half of the headrest is positioned on the front side of the chair back, and one-half of the headrest is positioned on the back side of the chair back. As a result, only one-half of the cushioning properties of the headrest are available for the head of a used. In this respect, it would be desirable if a headrest for a chair back were provided in which essentially the entire headrest is available for cushioning a person's head when the headrest is installed on the back of a chair.

Thus, while the foregoing body of prior art indicates it to be well known to use portable pillows or cushions that can be attached to the backs of chairs, the prior art described above does not teach or suggest a pillow apparatus which has the following combination of desirable features: (1) has straps that can be attached to Velcro located at the ends of the pillow; (2) has a pouch that is integral with a wall of the pillow; (3) has straps that can easily be attached to and detached from the ends of the pillow; (4) includes a single pillow portion for attaching to the back of a chair without employing a chair back reception slot or pocket; and (5) provides a headrest for a chair back in which essentially the entire headrest is available for cushioning a person's head when the headrest is installed on the back of a chair. The foregoing desired characteristics are provided by the unique pillow apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a pillow apparatus which includes a pillow unit having a first pillow end and a second pillow end which are situated along a longitudinal pillow axis. The pillow unit also includes a front pillow face and a rear pillow face. A first strap is connected to the first pillow end, and a second strap is connected to the second pillow end. The pillow unit can include a pillow housing and a pillow cushion retained in the pillow housing. The respective straps are adjustable so that the pillow unit can be adjusted on the back of a chair to accommodate the head and neck of different users.

A pocket assembly is connected to the pillow unit. The pocket assembly includes a zipper or hook and loop closure. The pocket assembly is connected to the rear pillow face.

Each of the first strap and the second strap includes a respective strap length first connector and a strap length second connector. Each strap length first connector is a first quantity of hook or loop material, and each strap length second connector is a second quantity of loop or hook material.

With one embodiment of the invention, the first strap and the second strap are connected to the respective pillow ends by respective strap-mounted snap connectors. The respective pillow ends includes pillow-mounted snap connectors for connection to the strap-mounted snap connectors. The pillow-mounted snap connectors are located along the longitudinal pillow axis. The pillow unit is cylindrical in shape and is symmetrical around the longitudinal pillow axis.

With another embodiment of the invention, the first strap includes a third quantity of hook or loop material that is located on the first strap distal to the first quantity of hook or loop material and the second quantity of loop or hook material. The first pillow end includes a fourth quantity of loop or hook material which is complementary to the third quantity of hook or loop material. In addition, the second strap includes a third quantity of hook or loop material that is located on the second strap distal to the first quantity of hook or loop material and the second quantity of loop or hook material. Also, the second pillow end includes a fourth quantity of loop or hook material which is complementary to the third quantity of hook or loop material.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pillow apparatus which has all of the advantages of the prior art and none of the disadvantages.

It is another object of the present invention to provide a new and improved pillow apparatus which may be easily and efficiently manufactured and marketed.

An even further object of the present invention is to provide a new and improved pillow apparatus which is susceptible of a low cost of manufacture with regard to both materials and labor, and which accordingly is then susceptible of low prices of sale to the consuming public, thereby making such pillow apparatus available to the buying public.

Still yet a further object of the present invention is to provide a new and improved pillow apparatus which has straps that can be attached to Velcro located at the ends of the pillow.

Still another object of the present invention is to provide a new and improved pillow apparatus that has a pouch that is integral with a wall of the pillow.

Yet another object of the present invention is to provide a new and improved pillow apparatus which has straps that can easily be attached to and detached from the ends of the pillow.

Even another object of the present invention is to provide a new and improved pillow apparatus that includes a single pillow portion for attaching to the back of a chair without employing a chair back reception slot or pocket.

Still a further object of the present invention is to provide a new and improved pillow apparatus which provides a headrest for a chair back in which essentially the entire headrest is available for cushioning a person's head when the headrest is installed on the back of a chair.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is a side view of the embodiment of the pillow apparatus of FIG. 2 wherein the attachment straps are in open, non-attachment positions.

FIG. 4 is a rear view of the embodiment of the invention shown in FIG. 3 taken along line 4—4 thereof.

DESCRIPTION OF THE PREFERRED EMBODIMENT

Figure 1:
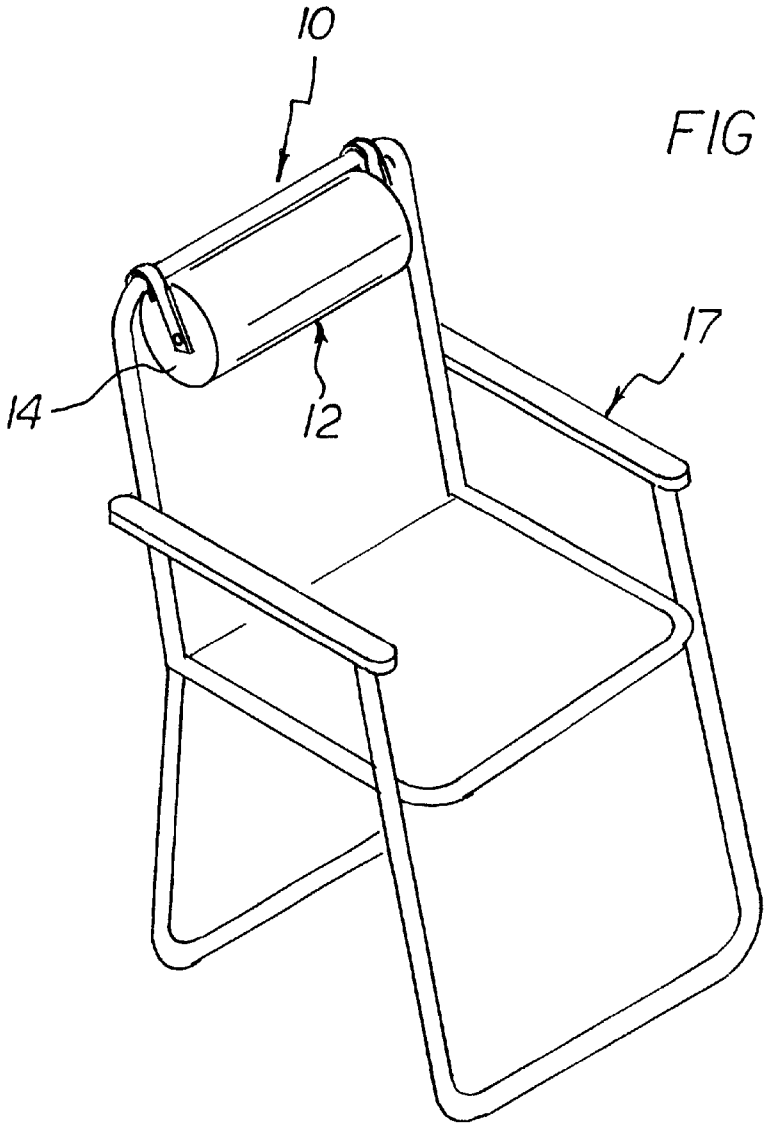
FIG. 1 is a front perspective view showing a first embodiment of the pillow apparatus of the invention attached to the back of a lawn chair.
Figure 2:
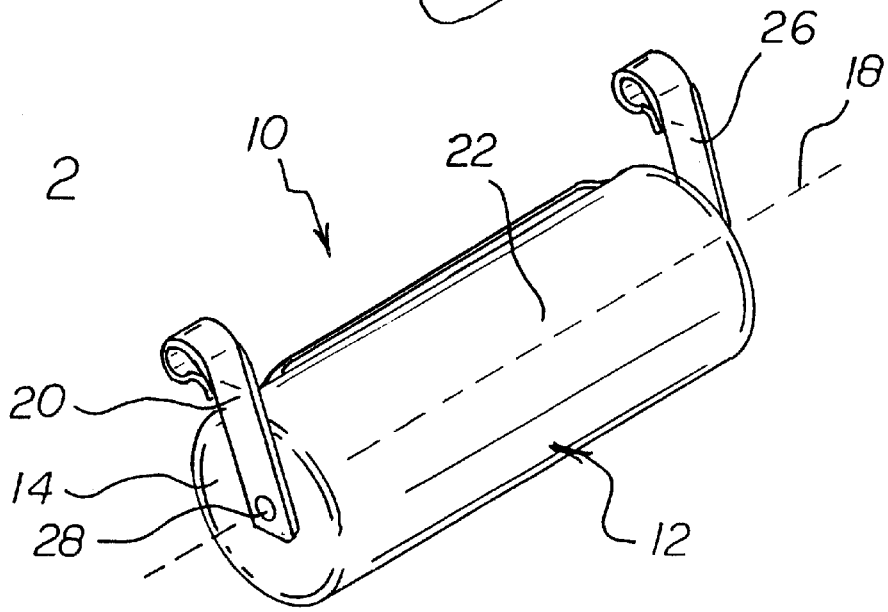
FIG. 2 is a front perspective view of the embodiment of the pillow apparatus shown in FIG. 1 removed from the chair, wherein attachment straps are in closed, attachment positions.
Figure 5:
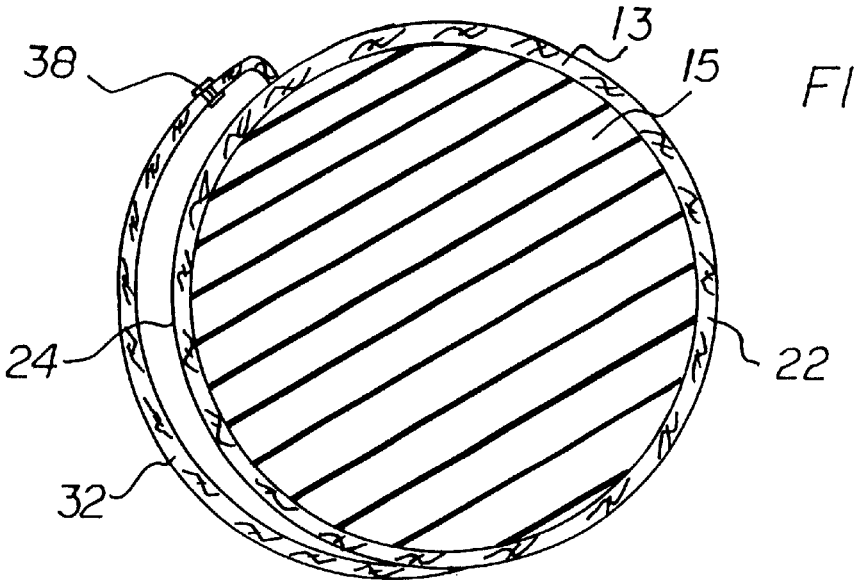
FIG. 5 is a cross-sectional view of the embodiment of the invention shown in FIG. 4 taken along line 5—5 thereof.
Figure 6:
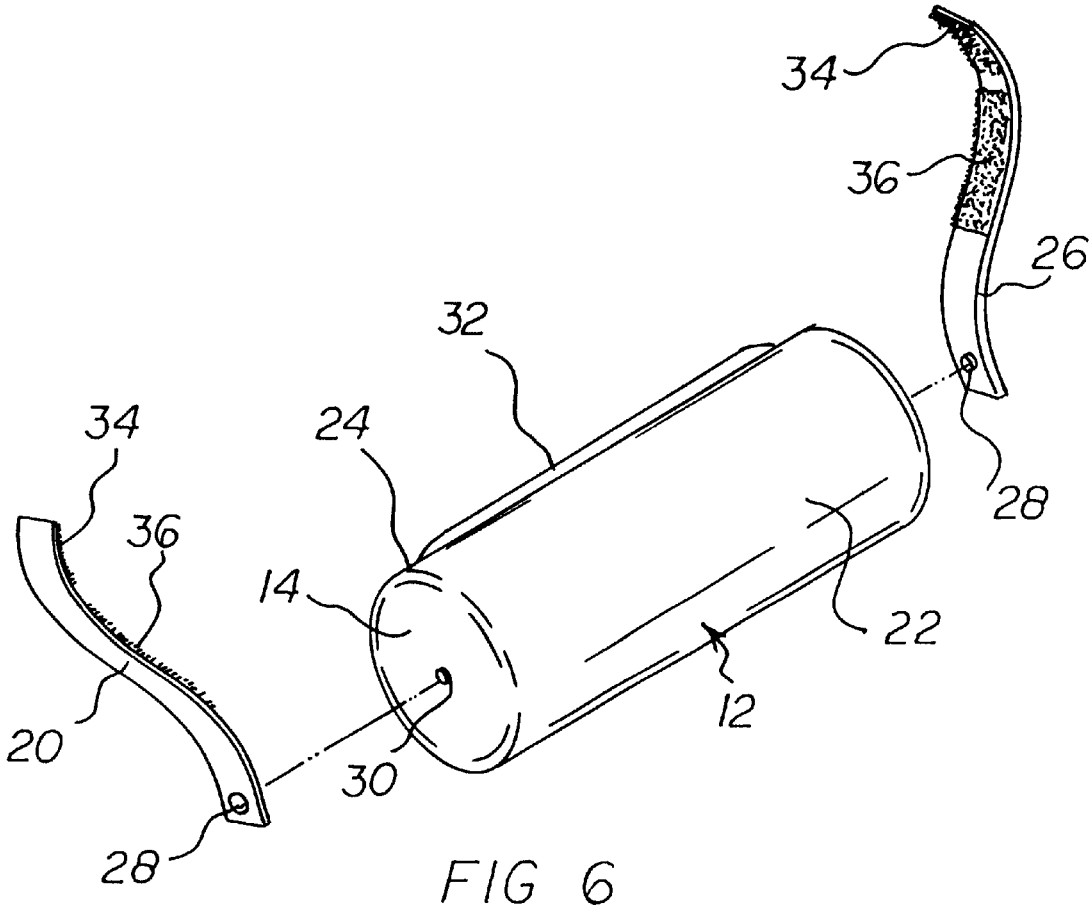
FIG. 6 is an exploded front perspective view of the embodiment of the invention shown in FIGS. 3 and 4.

With reference to the drawings, a new and improved pillow apparatus embodying the principles and concepts of the present invention will be described.

Turning to FIGS. 1–6, there is shown a first embodiment of the pillow apparatus of the invention generally designated by reference numeral 10. In its preferred form, pillow apparatus 10 includes a pillow unit 12 which includes a first pillow end 14 and a second pillow end 16 which are situated along a longitudinal pillow axis 18. The pillow unit 12 also includes a front pillow face 22 and a rear pillow face 24. A first strap 20 is connected to the first pillow end 14, and a second strap 26 is connected to the second pillow end 16. The pillow unit 12 can include a pillow housing 13 and a pillow cushion 15 retained in the pillow housing 13.

A pocket assembly 32 is connected to the pillow unit 12. The pocket assembly 32 includes a zipper 38. The pocket assembly 32 is connected to the rear pillow face 24.

Each of the first strap 20 and the second strap 26 includes a respective strap length first connector 34 and a strap length second connector 36. Each strap length first connector 34 is a first quantity of hook or loop material 34, and each strap length second connector 36 is a second quantity of loop or hook material 36. The first quantity of hook or loop material 34 and the second quantity of loop or hook material 36 are complementary and can be well known VELCRO™ material.

The first strap 20 and the second strap 26 are connected to the respective pillow ends by respective strap-mounted snap connectors 28. The respective pillow ends includes pillow-mounted snap connectors 30 for connection to the strap-mounted snap connectors 28. The pillow-mounted snap connectors 30 are located along the longitudinal pillow axis 18. The pillow unit 12 is cylindrical in shape and is symmetrical around the longitudinal pillow axis 18.

Use of the pillow apparatus 10 of the invention is shown in FIG. 1. More specifically, each of the first strap 20 and the second strap 26 is looped around the topmost member of a chair 17. More specifically, a respective strap is looped around the topmost member of the chair 17, and a respective first quantity of hook or loop material 34 is attached to a respective second quantity of loop or hook material 36 for a respective strap. The pillow apparatus 10 is attached to the chair 17 so that the pocket assembly 32 faces towards the area behind the chair 17 and so that the front pillow face 22 faces towards the area in front of the chair 17.

The position of the pillow unit 12 on the back of the chair 17 is adjusted by the positioning of the respective first quantity of hook or loop material 34 on the second quantity of loop or hook material 36. When the first quantity of hook or loop material 34 is positioned on a more proximal portion of the second quantity of loop or hook material 36, the pillow unit 12 can hang relatively low on the back of the chair 17. In contrast, when the first quantity of hook or loop material 34 is positioned on a more distal portion of the second quantity of loop or hook material 36, the pillow unit 12 is supported relatively high on the back of the chair 17. As a result, the straps can be used to adjust the pillow unit 12 to accommodate different head and neck positions of different persons seated on the chair 17.

The adjustable straps of the pillow apparatus 10 of the invention permit the pillow apparatus 10 to be used on a wide variety of lawn, pool, or beach chairs. Moreover, the pillow housing 13 and the pocket assembly 32 can be made from 40 waterproof materials so that the pillow cushion 15 and any contents of the pocket assembly 32 are protected from water in wet environments.

If desired, the first strap 20 and the second strap 26 can be removed from the pillow unit 12, and the pillow unit 12 can be used independently of the chair 17. To remove the first strap 20 from the pillow unit 12. A first strap-mounted snap connector 28 is unsnapped from a first pillow-mounted snap connector 30. To remove the second strap 26 from the pillow unit 12. A second strap-mounted snap connector 28 is unsnapped from a second pillow-mounted snap connector 30. To restore the pillow apparatus 10 to its use on a chair 17, the strap-mounted snap connectors 28 of the respective straps are reconnected to the pillow-mounted snap connectors 30, whereby the respective straps are reconnected to the pillow unit 12.

Figure 7:
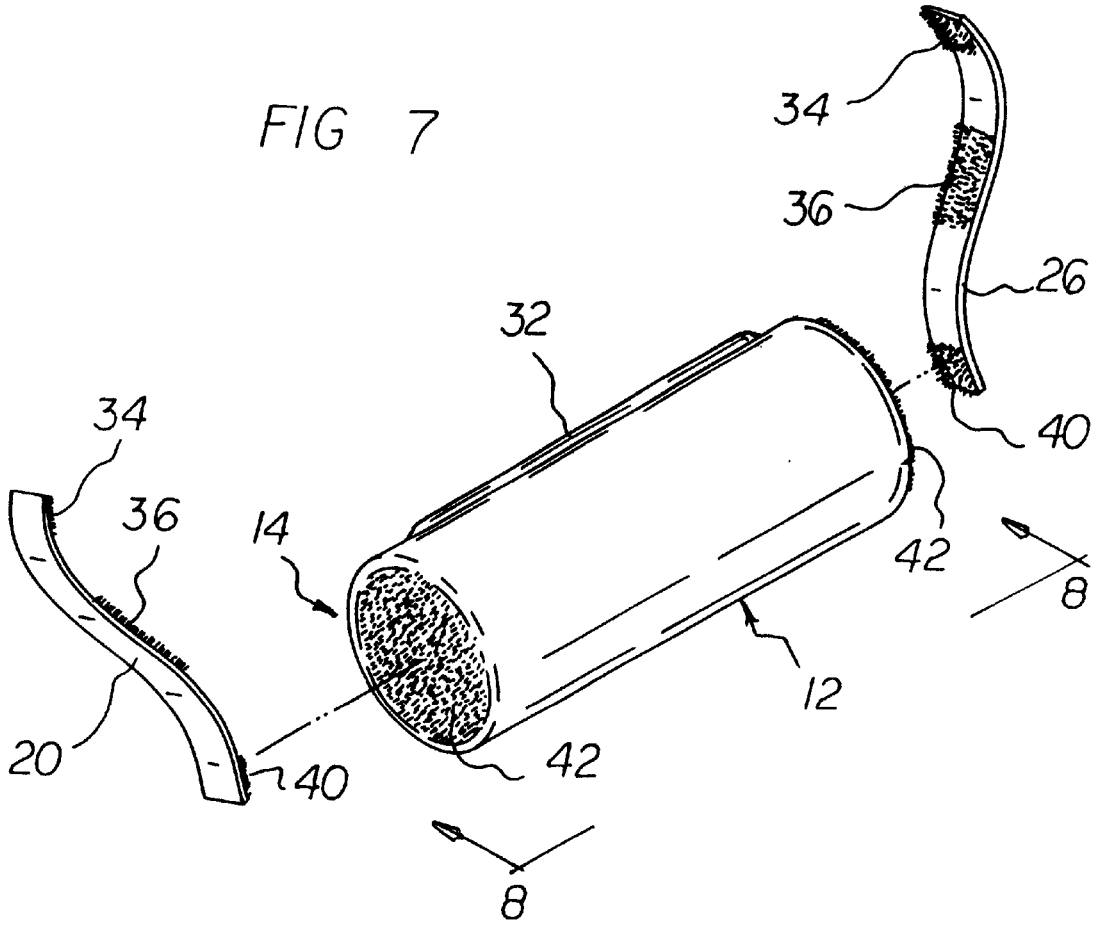
FIG. 7 is an exploded front perspective view of a second embodiment of the invention in which quantities of loop or hook material are located on the pillow ends of the pillow unit and in which quantities of complementary hook or loop material are located at ends of the straps.
Figure 8:
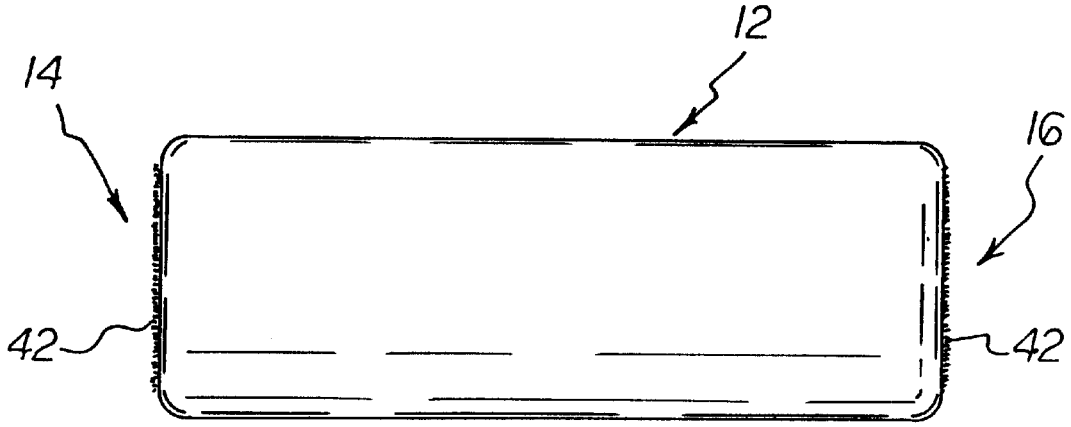
FIG. 8 is a front view of the embodiment of the invention shown in FIG. 7 with the straps removed from the pillow unit.

Turning to FIGS. 7 and 8, a second embodiment of the invention is shown. Reference numerals are shown that correspond to like reference numerals that designate like elements shown in the other figures. In addition, the first strap 20 includes a third quantity of hook or loop material 40 that is located on the first strap 20 distal to the first quantity of hook or loop material 34 and the second quantity of loop or hook material 36. The first pillow end 14 includes a fourth quantity of loop or hook material 42 which is complementary to the third quantity of hook or loop material 40. In addition, the second strap 26 includes a third quantity of hook or loop material 40 that is located on the second strap 26 distal to the first quantity of hook or loop material 34 and the second quantity of loop or hook material 36. Also, the second pillow end 16 includes a fourth quantity of loop or hook material 42 which is complementary to the third quantity of hook or loop material 40.

To use the second embodiment of the invention, the third quantity of hook or loop material 40 on each strap 20,26 can be placed against virtually any portion of a respective fourth quantity of loop or hook material 42 on a respective pillow end 14,16 to bond the respective strap 20,26 to the pillow unit 12. In this way, the straps 20,26 can be secured to the pillow unit 12 without careful concern for precise positioning of the straps 20,26 at a hard-to-find location on the pillow ends 14,16. In addition, if desired, the zipper 38 can be replaced with complementary quantities of hook and loop material, e.g. VELCRO™, as a closure for the pocket assembly 32.

The components of the pillow apparatus of the invention can be made from inexpensive and durable metal, plastic, cloth, and cushion materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved pillow apparatus: that is low in cost, relatively simple in design and operation, and which may advantageously have straps that can be attached to Velcro located at the ends of the pillow. With the invention, a pillow apparatus is provided which has a pouch that is integral with a wall of the pillow. With the invention, a pillow apparatus is provided which has straps that can easily be attached to and detached from the ends of the pillow. With the invention, a pillow apparatus is provided which includes a single pillow portion for attaching to the back of a chair without employing a chair back reception slot or pocket. With the invention, a pillow apparatus provides a headrest for a chair back in which essentially the entire headrest is available for cushioning a person's head when the headrest is installed on the back of a chair.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A pillow apparatus, comprising:

a pillow unit which includes a first pillow end and a second pillow end which are situated along a longitudinal pillow axis, and which includes a front pillow face and a rear pillow face, a first strap connected to said first pillow end, and a second strap connected to said second pillow end, wherein at least said first strap includes first and second opposed ends, a first connector located adjacent said first strap first opposed end, a second connector located adjacent said first strap second opposed end, and a third connector located intermedially between said first connector and said second connector, wherein said at least first strap has first and second opposed sides, said first, second and third connectors being located said first opposed side thereof, wherein at least said first and third connectors each comprises a quantity of complimentary hook or loop material such that said first and third connectors may be adjustably and removably connected to each other, and wherein at least said first pillow end includes a fourth connector engageable with said second connector.

2. The apparatus of claim 1 wherein said pillow unit includes a pillow housing and a pillow cushion retained in said pillow housing.

3. The apparatus of claim 1 further including:

a pocket assembly connected to said pillow unit.

4. The apparatus of claim 3 wherein said pocket assembly includes a zipper.

5. The apparatus of claim 3 wherein said pocket assembly is connected to said rear pillow face.

6. The apparatus of claim 1 wherein said first opposed side of said at least first strap has a longitudinal extent, wherein said first and said third connectors are spaced longitudinally from each other along said first opposed side, and wherein said third connector occupies a greater longitudinal extent along said first opposed side of said at least first strap relative to the longitudinal extent occupied by said first connector along said first opposed side of said at least first strap.

7. The apparatus of claim 1 wherein said pillow ends have a pair of connectors, respectively, and said second connector is adapted to be engaged with at least one of said pair of pillow end connectors.

8. The apparatus of claim 7 wherein said second connector is a snap connector and said pair of pillow end connectors comprises complementary snap connectors.

9. The apparatus of claim 7 wherein said second connector comprises a quantity of hook or loop fastener material and said pair of pillow end connectors comprises quantities of complementary loop or hook fastener material.

10. The apparatus of claim 9 wherein the pillow unit is cylindrically shaped and wherein the pillow ends are circular shaped, and wherein said pair of pillow end connectors comprises quantities of complementary loop or hook fastener material extending substantially over the entire surface of each circular shaped end, respectively.

* * * * *